US005397200A

United States Patent [19]

Seal

[11] Patent Number: 5,397,200

[45] Date of Patent: Mar. 14, 1995

[54] SPREADER/GRADER WITH ADJUSTABLE TRANSVERSE BLADES

[76] Inventor: James C. Seal, 9190 Dummyline Rd., Picayune, Miss. 39466

[21] Appl. No.: 126,567

[22] Filed: Sep. 27, 1993

[51] Int. Cl.[6] ..... E01C 19/22; E02F 3/76

[52] U.S. Cl. ..... 404/118; 172/393; 172/445.1; 172/448

[58] Field of Search ..... 404/96, 118, 106; 172/393, 445.1, 684.5, 741, 744, 448

[56] References Cited

U.S. PATENT DOCUMENTS

| | | | |
|---|---|---|---|
| 1,232,314 | 7/1917 | Hubbard | 172/393 |
| 1,393,385 | 10/1921 | Lyttle et al. | 172/393 |
| 4,196,778 | 4/1980 | Smith | 172/199 |
| 4,320,988 | 3/1982 | Seal | 404/118 |
| 5,191,943 | 3/1993 | Minor et al. | 172/393 |
| 5,332,331 | 7/1994 | Critz et al. | 404/96 |

*Primary Examiner*—Ramon S. Britts
*Assistant Examiner*—James A. Lisehora
*Attorney, Agent, or Firm*—Jacobson, Price, Holman & Stern

[57] ABSTRACT

A spreader/grader attachable to a three point hitch of a tractor and including a pair of longitudinally extending, parallel, transversely spaced side pans or frame members oriented in fixed relation to each other and operatively connected to a three point hitch. Extending between the side pans or frame members is a plurality of transverse blades for engaging a soil surface in order to perform various earth working functions. The blades include a support structure and attachment arrangement at each end thereof for connection with the side pans or frame members to enable the blades to be oriented in a fixed or varied relation to the frame members or adjustable in relation to the frame members to orient either end of a blade forwardly or rearwardly in relation to the other end and either end of the blade upwardly or downwardly in relation to the other end and to vary the angle of a blade about a longitudinal axis with respect to a horizontal plane to vary the angle of attack of the blade in relation to the soil surface in order to provide effective grading, spreading and other earth working functions.

11 Claims, 2 Drawing Sheets

SPREADER/GRADER WITH ADJUSTABLE TRANSVERSE BLADES

BACKGROUND OF THE INVENTION

1. Field of the Invention

This invention relates to a spreader/grader attachable to a three point hitch of a tractor and including a pair of longitudinally extending, parallel, transversely spaced side pans or frame members oriented in fixed relation to each other and operatively connected to a three point hitch. Extending between the side pans or frame members is a plurality of transverse blades for engaging a soil surface in order to perform various earth working functions. The blades include a support structure and attachment arrangement at each end thereof for connection with the side pans or frame members to enable the blades to be oriented in a fixed or varied relation to the frame members or adjustable in relation to the frame members to orient either end of a blade forwardly or rearwardly in relation to the other end and either end of the blade upwardly or downwardly in relation to the other end and to vary the angle of a blade about a longitudinal axis with respect to a horizontal plane to vary the angle of attack of the blade in relation to the soil surface in order to provide effective grading, spreading and other earth working functions.

2. Description of the Prior Art

This invention represents improvements in my prior U.S. Pat. No. 4,320,988 issued Mar. 23, 1982 which discloses a spreader/grader attached to a three point hitch and includes transversely spaced, parallel side pans or side frame members supporting transversely extending blades which can be used for various earth working purposes. The prior art cited in that patent relates to this invention as does the structure in U.S. Pat. No. 5,191,943 issued Mar. 9, 1993 and the prior art cited in that patent all of which are made of record herein by reference thereto.

While the above prior art discloses spreaders/graders attached to a three point hitch which include rigidly spaced side pans or frame members having earth working blades supported therefrom in which the blades are capable of adjustment or variation about a transversely extending axis and capable of vertical adjustment by moving both ends of the blades an equal amount, the prior art does not disclose a structure equivalent to the present invention in which the blades can be rigidly fixed in various positions or adjustably positioned due to the particular construction of the blade support structure and the connection between the blade support structure and the side pans or side frame members.

SUMMARY OF THE INVENTION

An object of the present invention is to provide a spreader/grader including a rigid frame structure attachable to a three point hitch of a tractor to enable the spreader/grader to be elevated and lowered in a manner well known by operating the three point hitch with the rigid frame including side pans or frame members that are parallel to each other and rigidly connected by transverse frame members together with unique and novel transversely extending earth working blades and support structures for the blades having unique and novel connecting structure with the side pans or frame members.

Another object of the invention is to provide a spreader/grader in accordance with the preceding object in which the blade supports or adapters are adjustable lengthwise in relation to the blades to compensate for the difference in the effective distance between attachment points to the side pans or frame members when the blade supports or adapters and blades are oriented in positions other than perpendicular to the side pans or frame members.

A further object of the invention is to provide a spreader/grader in accordance with the preceding objects in which the blade supports are connected to the side pans or frame members by a universal pivotal connection to accommodate the difference in angular relation between the side pans or frame members and the blades.

Still another object of the invention is to provide a spreader/grader in accordance with the preceding objects in which the ends of the blade supports are connected to the side pans or frame members by the use of an elongated mounting plate that is vertically adjustably mounted on the side pans or frame members and connected to the side pans at longitudinally spaced positions to enable either end of the blades to be vertically adjusted by a vertically slotted connection and positioned adjustably lengthwise of the side pans with the lengthwise adjustment of the blade supports in relation to the blades and the pivotal connecting structure compensating for the length variation when the ends of the blade assemblies are moved vertically and lengthwise of the side pans in relation to each other.

A still further object of the invention is to provide blade supports or adapters that are lengthwise adjustably connected with the blades with the outer end of each blade support or adapter including a rigid end plate oriented in fixed angular relation to the longitudinal axis of the blade thereby enabling the earth working blades to be oriented in different angular relation to the side pans by switching left and right adapters or supports and by providing supports or adapters having end plates in different angular relation to the longitudinal axis of the blade.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
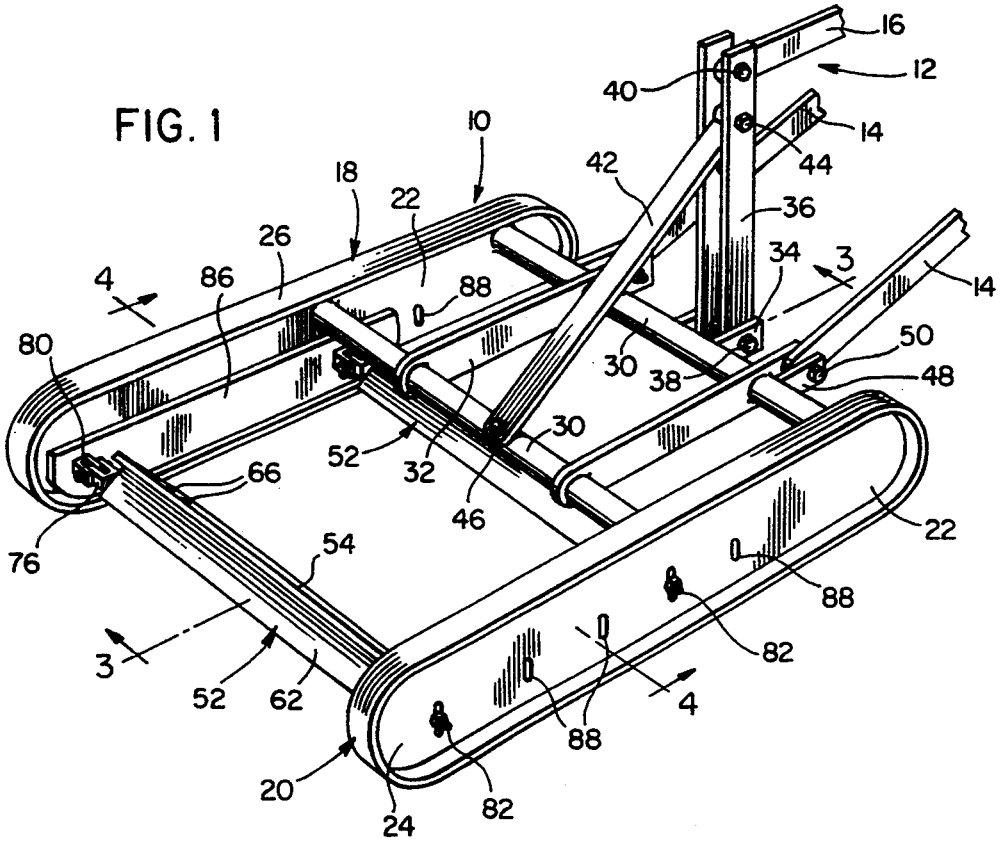
FIG. 1 is a perspective view of the spreader/grader illustrating its association with a three point hitch and the structure of the rigid frame and blade assemblies associated therewith.

As illustrated in FIG. 1, the spreader/grader of the present invention, generally designated by reference numeral 10, is connected to a three point hitch assembly of a conventional tractor generally designated by reference number 12. Various types of tractors and similar towing vehicles may be used which include a three point hitch including a pair of lower links or arms 14 and an upper arm or link 16 which constitute a conventional three point hitch assembly.

The spreader/grader includes a rigid frame structure 18 which includes a pair of side pans or frame members 20 in the form of a vertical plate 22 having semicircular ends or rounded ends 24 and a peripheral transverse flange 26 with the lower flange engaging the ground surface 28 when the spreader/grader is lowered by lowering the three point hitch. This structure provides a substantially I-beam cross-sectional configuration for the side pans or frame members. Rigidly connecting the side pans or frame members 20 is a pair of torque bars in the form of rigid tubular members 30 welded or otherwise fixedly secured to the side plates 22 to maintain the side pans or frame members 20 in rigid, transversely spaced, parallel relation. The cross sectional configuration of the side pans or frame members and the tubular members 30 may vary as long as the frame 18 provides a rigid structure with spaced parallel side frame members. Also, the length, width and depth of the grader/-spreader may vary depending upon job requirements.

The transverse members 30 are provided with longitudinal connecting members 32 to rigidify the frame and the forward transverse member 30 is provided with a pair of spaced, centrally disposed lugs 34 receiving a pair of upstanding links 36 pivoted thereto by pivot bolt 38 with the upper end of the links 36 being connected to the upper arm or link 16 by pivot bolt 40. The upper end portion of the links 36 are also connected to a rearwardly and downwardly inclined brace 42 by a bolt structure 44 and the rear lower end of the brace 42 is secured to the rear transverse member 30 by a bolt 46. The forward transverse member 36 is also provided with two pairs of spaced lugs 48 extending forwardly therefrom in laterally spaced relation to the lugs 34 for connection with the lower arms or links 14 by bolts 50 thereby connecting the spreader/grader to the three point hitch to enable the tractor operator to raise and lower the spreader/grader when operating the three point hitch control valve assembly in a conventional manner. The above described structure is substantially similar to the frame and hitch structure disclosed in my prior U.S. Pat. No. 4,320,988.

Figure 3:
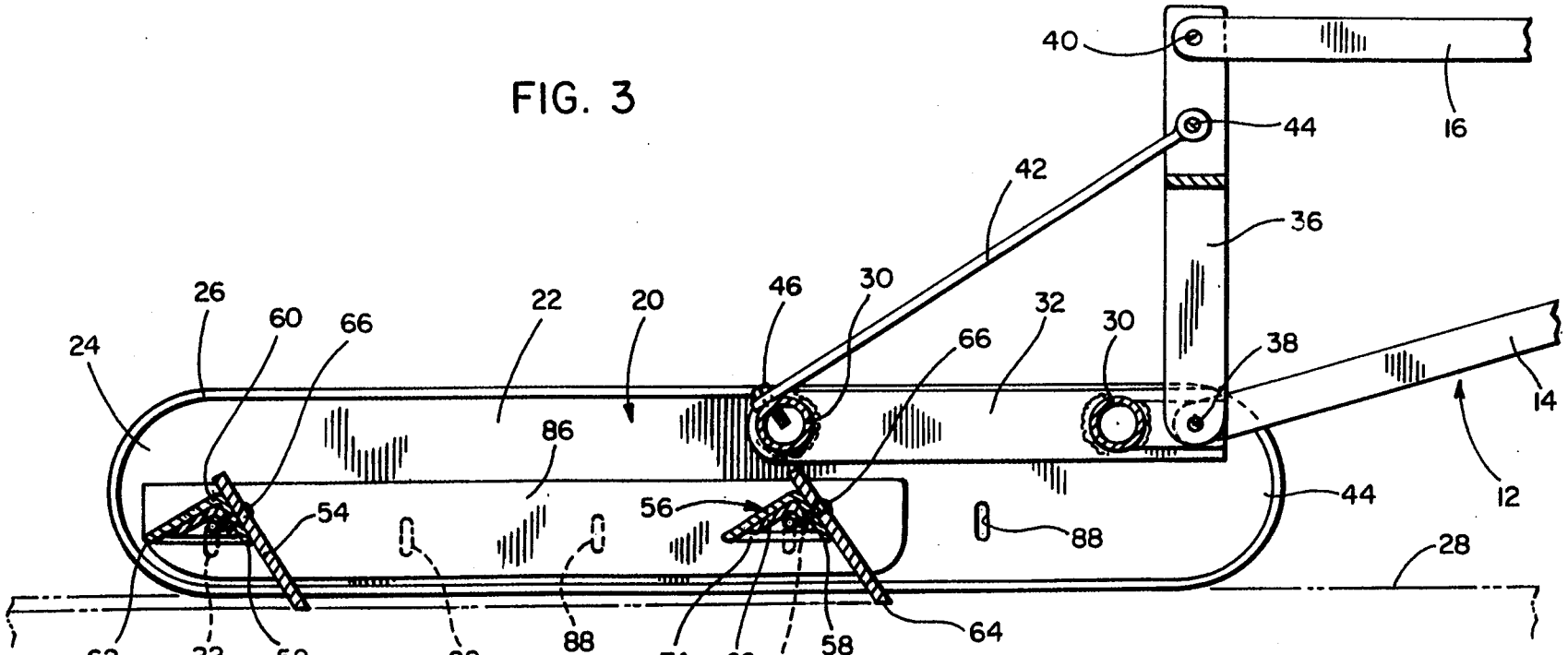
FIG. 3 is a longitudinal, sectional view, on an enlarged scale, taken along section line 3—3 on FIG. 1 illustrating further structural details of the blade assemblies.
Figure 4:
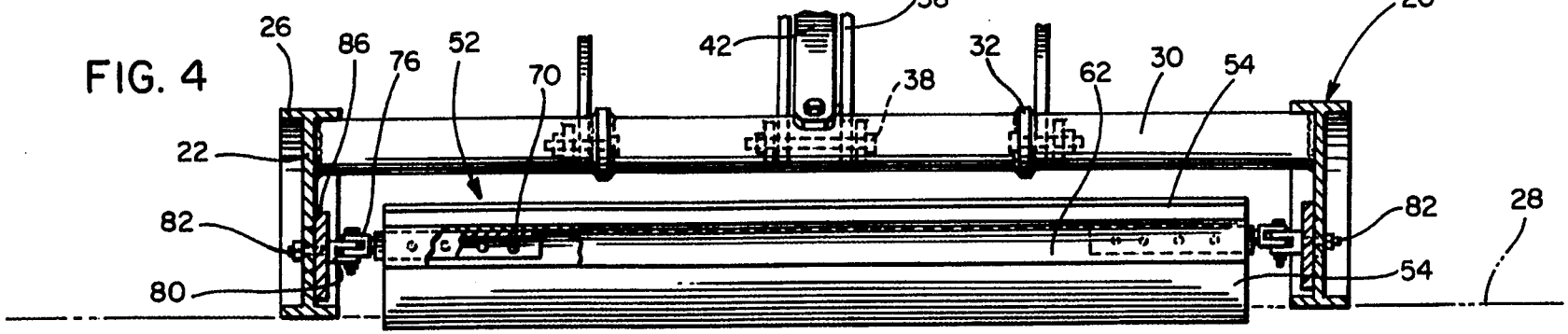
FIG. 4 is a transverse, sectional view, on an enlarged scale, taken along section line 4—4 on FIG. 1 illustrating further structural details of the blade assemblies.

Extending between the frame members 20 is a plurality of blade assemblies 52 each of which includes an inclined blade 54 and a blade support or adaptor 56 having a right angle transverse cross-section as illustrated in FIG. 3 or a tubular triangular configuration and which includes a forward and downwardly inclined leg or flange 58 extending from an apex 60, a rearwardly and downwardly inclined leg or flange 62 extending oppositely from the apex 60 and an optional bottom wall. The blade 54 is generally of elongated rectangular configuration generally in the form of a flat plate having a bevelled or inclined lower cutting edge 64 with the blade 54 being secured to the downwardly inclined leg or flange 58 by attaching bolts 66.

At each end of the blade support 56, a longitudinally extending bracket or carriage 68 is mounted which is oriented in telescopic underlying relation to the blade support 56 and is of the same transverse configuration as illustrated in FIG. 3 and which includes a plurality of longitudinally spaced apertures 70 alignable with and receiving the bolts 66 which enables the bolts 66 to be received in selected apertures 70 to enable longitudinal adjustment of the bracket 68 in relation to the blade support 56 with the bolts 66 which secure the blade 54 in position also securing the bracket 68 in longitudinally adjusted relation to the blade support 56. This longitudinal adjustment enables the effective length of the combined blade support 56 and bracket 68 to be adjusted to compensate for the different effective length of the blade assembly 52 when the opposite ends thereof are located at different positions longitudinally and vertically with respect to the frame members 20.

The outer end of the bracket 68 is provided with an end closure plate 72 and the outer ends of the flanges 62 and 58 of blade support 56 are connected by a connecting strap 74 which may be a continuous bottom wall to rigidify the end of the blade support 56 and the end of the bracket 68.

Figure 2:
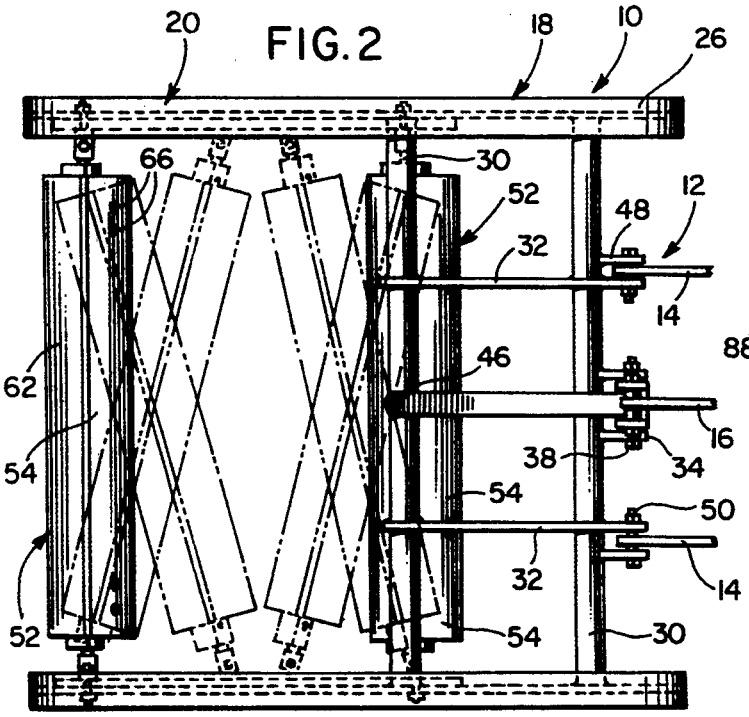
FIG. 2 is a top plan view of the structure illustrated in FIG. 1.
Figure 5:
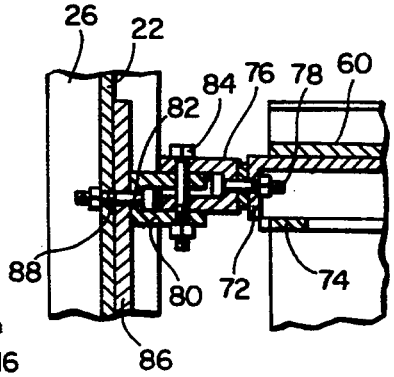
FIG. 5 is a fragmental sectional view of the universal pivotal connection between the blade support and the vertically and lengthwise adjustable plate and the side pan or frame member.

The connection between each end of the blade assembly 52 and the adjacent frame member 20 is illustrated in detail in FIG. 5 and includes a U-shaped clevis 76 having its bight portion connected pivotally to the end plate 72 on the bracket 68 by a pivot bolt 78. A similar but oppositely facing U-shaped clevis 80 is connected to the side frame member 20 by a pivot bolt 82 which extends through the bight portion of the U-shaped clevis 80. The leg portions of the U-shaped clevises 76 and 80 overlap and interfit as illustrated in FIG. 5 and are pivotally connected by a pivot bolt 84 thereby enabling universal angular adjustment of the blade assembly in relation to the frame member 20 about an axis defined by the pivot bolts 78 and 82 and about an axis perpendicular thereto about pivot bolt 84 which enables the blade assemblies to be adjusted into various transverse angular positions as illustrated in the plan view of FIG. 2. This also enables the adjustment of the blade assembly about a transversely extending, generally horizontal axis to orient the blade 54 in different angular positions about its longitudinal axis with respect to the ground surface 28 being engaged by the blades 54 with the universal pivotal connection providing for the variation in the angular relation between the ends of the blade support and bracket and the frame members.

The shape, size and configuration of the blade support and brackets may vary but in one working embodiment of the invention, the blade support 56 is a 4 inch by 6 inch by $\frac{5}{8}$ inch angle iron and the bracket 68 is a 3 inch by 5 inch by $\frac{1}{2}$ inch angle iron having a length of 16 inches or other length substantially shorter than the blade support which enables sufficient overlap to provide adequate adjustment in the effective length of the blade support while maintaining rigidity between the bracket and blade support and rigid support for the blade.

The bracket 68 at each end of the blade assembly 52 is also connected to an elongated support plate 86 which extends along the interior surface of the plate or side pan 22 of the frame member 20 and is generally about $\frac{1}{2}$ of the length and height of the side members 20 as illustrated in the drawings. The side pans 22 are provided with a plurality of longitudinally spaced vertical slots 88 which receive bolts 82. The plate 86 also includes longitudinally spaced holes 90 receiving the bolts 82. This structure enables the bolts 82, the brackets 68 and the plate 86 to be adjusted vertically as the bolts move in the slots 88. By disconnecting the bolts 82, the plates 86 can be repositioned in longitudinally adjusted position on the side pans 22 with the holes 90 aligned with another vertical slot 88 to enable reinsertion of bolt 82 thus enabling adjustment of either end of the blade assembly 52 vertically and horizontally. The effective change in length of the blade assembly 52 when its angular relation to the side frame members 20 is changed is compensated for by removing bolts 66 and moving bracket 68 longitudinal in relation to blade support 56 and reinserting bolts 66. The plates 86 form hanger plates for the U-shaped clevises 80 and the mounting bolts 82 therefor which enables the clevises 80 and the corresponding end portions of the blade assemblies 52 to be vertically adjusted on the side pans 22 thus moving either end of the blade 54 upwardly or downwardly by adjusting the bolts 82 and hanger plate 86 vertically in relation to the side pan 22 forming the side frame member 20. The universal pivotal connection and the adjustable connection between the bracket 68 and the blade support 56 compensates for the difference in length of the blade assembly when either end thereof is vertically adjusted or moved longitudinally relative to the other end and bolts 82 enable pivotal movement of blade 54 about a longitudinal axis. The side plates 22 include a plurality of slots 88 receiving the bolts 82. Additional bolts may be used to secure the hanger plate 86 to the side pans 22 by inserting them through unused slots or apertures in the plates 86 and side pans 22 which are in addition to bolts 82.

Figure 6:
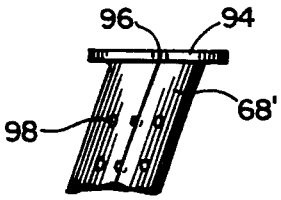
FIG. 6 is a fragmental side elevational view of the embodiment of blade support having an angled end plate welded thereon.

As illustrated in FIG. 6, the bracket 68' includes an end plate 94 welded thereto at a fixed angle in relation to the longitudinal axis of the blade assembly with the plate 94 including a central aperture 96 for receiving bolt 82 to rigidly connect the blade assembly to plate 86 and side pans 22. The bracket 68' is of tubular triangular configuration with longitudinally spaced apertures 98 in each wall thereof. The end plate 94 may also be triangular and the brackets 68' are provided in pairs with each pair having the end plates 94 at a predetermined angle. This enables the ends of the blade assemblies to be oriented with either end forwardly of the other by switching the bracket 68' from end to end of the blade assembly. The three walls or sides of the bracket 68' enables the blade assembly and brackets to be mounted in a left or right fixed angular position in relation to the side pans 22 with the vertical and lengthwise adjustment being maintained by bolts 82 extending through the plate 86 and slotted side pans 22.

As indicated, various functions can be accomplished by use of the spreader/grader and the blades can vary in number and the transverse variable angle enables the blades to crown a soil surface to the left or to the right and the blades can be oriented perpendicular or vertically adjusted at either end and adjusted about a transverse axis. A lesser number of blades or a greater number of blades may be supported between the side pans or frame members and the blades and side frame members can be permanently and fixedly related if desired.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A spreader/grader for attachment to a three point hitch of a tractor for various earth working functions and comprising:

a rigid frame, means on said frame for connection with a three point hitch of a tractor, and means on said frame for engaging a soil surface and performing earth working functions, said frame comprising a pair of rigid side frame members, a plurality of torque bars rigidly interconnecting said side frame members and maintaining the side frame members in rigid, spaced parallel relation for movement along a ground surface when in a lowered position and elevated above the ground surface when in an elevated position, said means engaging a soil surface comprising at least one blade assembly extending transversely between said side frame members, said blade assembly having two ends and including an elongated blade support having a downwardly and forwardly inclined flange and an earth working blade attached to said flange, each said end of said blade assembly including a bracket longitudinally telescopic in relation to the blade support and at least one mounting bolt securing each of said brackets to said blade and to said blade support, each bracket including a plurality of apertures capable of receiving said at least one mounting bolt and thereby providing length adjustment to said blade support assembly, said spreader/grader further comprising means for connecting the brackets to the side frame members, said means for connecting the brackets including means permitting independent adjustment of each end of the blade assembly forwardly and rearwardly in relation to the other end of the blade assembly.

2. The spreader/grader as defined in claim 1 wherein said means for connecting the brackets to the side frame members further includes means for enabling variation in an angular relation of the blade about a transverse, generally horizontal axis and adjustment of either end of the blade vertically.

3. The spreader/grader as defined in claim 2 wherein said means for connecting each of said brackets to the side frame members includes a pair of U-shaped clevises having a pivotal connection with each other about an axis generally perpendicular to a transverse axis and a pivotal connection with the bracket and a pivotal connection with a side frame member about an axis generally parallel to the longitudinal axis of the blade.

4. The spreader/grader as defined in claim 3 wherein the longitudinally telescopic adjustable connection of the bracket to the blade support enables the blade assembly to be oriented with either end of the blade assembly forwardly or rearwardly of the other end with the adjustment of the brackets compensating for increased effective length of the blade assembly when oriented in various angular relations to the side frame members with one end of the blade assembly forwardly or rearwardly of the other.

5. The spreader/grader as defined in claim 4 wherein each of said side frame members includes a hanger plate oriented along an inner surface thereof, means vertically adjustably supporting the hanger plate in relation to the side frame member, one of said clevis members being pivotally connected to said hanger plate and side frame member for vertical adjustment therewith thereby enabling either end of the blade assembly to be vertically adjusted in relation to the other end with the longitudinal telescopic adjustment of the bracket in relation to the blade support compensating for the increased effective length of the blade assembly when either end of the blade assembly is vertically adjusted in relation to the other end.

6. The spreader/grader as defined in claim 5 wherein each of said side frame members includes a plurality of longitudinally spaced, vertically elongated slots, a bolt extending through said one clevis, said hanger plate and a selected slot in the side frame member to enable vertical adjustment of the hanger plate and the end of the blade assembly, fore and aft adjustment of the hanger plate and the end of the blade assembly by extending the bolt through a selected vertical slot in the side frame member and pivotal movement of the blade assembly about an axis generally parallel to the longitudinal axis of the blade.

7. The spreader/grader as defined in claim 6 wherein said means connecting the brackets to the side frame members includes an end plate on an outer end of each bracket, said end plates being rigidly connected to said brackets in angular relation to a transverse axis perpendicular to said side frame members, each of said side frame members including a plurality of longitudinally spaced vertical slots therein receiving a bolt extending through the end plate and side frame member to enable vertical adjustment of each end of the blade assembly, said brackets being selectively mounted on opposite ends of the blade assembly to enable the blade assembly to be rigidly fixed in oppositely oriented angular relation to said side frame members.

8. The spreader/grader as defined in claim 1 wherein a plurality of blade assemblies are disposed between said side frame members with the connection between the blade assemblies and side frame members enabling the blade assemblies to be oriented in various angular positions with the opposite ends of the blade assemblies being adjusted forwardly and rearwardly of the frame members and either end of the blade assemblies adjusted vertically in relation to the frame assemblies and each blade assembly being adjusted about a generally transverse axis extending between the side frame members to vary the angular orientation of the blade in relation to the soil surface.

9. An earth working implement comprising a frame, means on said frame for connection with a vehicle, and means on said frame for engaging a soil surface and performing earth working functions, said frame comprising a pair of rigid side frame members, means rigidly interconnecting said side frame members and maintaining them in rigid, spaced parallel relation for movement along a ground surface when in a lowered position and elevated above the ground surface when in an elevated position, said means engaging a soil surface comprising at least one blade assembly extending transversely between said side frame members, said blade assembly having two ends and including an elongated blade support, an earth working blade attached to said blade support, each end of said blade assembly including a bracket extending outwardly from the blade supporting, first fastening means detachably securing the blade support and brackets and second fastening means detachably securing the brackets to said side frame members, each said second fastening means enabling variation in the angular relation of the blade about a transverse, generally horizontal axis and enabling adjustment of each end of the blade vertically, and said first fastening means and said second fastening means cooperating with one another to provide independent adjustability of each end of the blade assembly forwardly and rearwardly.

10. The earth working implement as defined in claim 9 wherein each said second fastening means includes a pair of U-shaped clevises having pivotal connection with each other about an axis generally perpendicular to a transverse axis and a pivotal connection with the bracket and a pivotal and vertically adjustable connection with a side frame member about an axis generally parallel to a transverse axis of the blade.

11. The earth working implement as defined in claim 9 wherein each said second fastening means includes an end plate rigidly mounted on an outer end of said bracket in angular relation to a longitudinal axis of the blade assembly, and bolt means detachably connecting said end plates to said side frame members to enable the brackets to be switched from one end to the other of said blade assembly to enable the blade assembly to be positioned in opposite angled relation in relation to said side frame members.

* * * * *